US006449993B2

(12) United States Patent
Elliott et al.

(10) Patent No.: US 6,449,993 B2
(45) **Date of Patent: *Sep. 17, 2002**

(54) COMBINED HANDLE AND LOCK ASSEMBLY FOR A SHIPPING CASE

(75) Inventors: Edwin B. Elliott, Wheeling, IL (US); James S. Burkey, Columbus, OH (US)

(73) Assignee: Jelco, Inc., Wheeling, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,223

(22) Filed: Feb. 23, 2000

(51) Int. Cl.[7] ..... B65D 55/14

(52) U.S. Cl. ..... 70/63; 70/207; 292/DIG. 31; 220/756; 206/510

(58) Field of Search ..... 70/63, 64, 67–76, 70/208, 213, 312, 207, 209, DIG. 31, DIG. 58; 292/336.3, DIG. 30, DIG. 31; 190/19, 39; 206/506, 510; 220/752, 756, 760–765, 768, 770, 771, 773

(56) References Cited

U.S. PATENT DOCUMENTS

| | | | | | |
|---|---|---|---|---|---|
| 1,251,436 | A | * | 12/1917 | Snyder | 70/70 X |
| 1,370,942 | A | * | 3/1921 | Binkley | 70/70 |
| 1,645,992 | A | * | 10/1927 | Hinde | 220/756 X |
| 2,016,895 | A | * | 10/1935 | Ford | 292/DIG. 31 X |
| 2,131,033 | A | * | 9/1938 | Barrington et al. | 292/DIG. 31 X |
| 2,136,854 | A | * | 11/1938 | Knott | 292/DIG. 31 X |
| 2,164,150 | A | * | 6/1939 | Brewster | 292/DIG. 31 X |
| 2,278,534 | A | * | 4/1942 | Dickason | 292/DIG. 31 X |
| 3,626,730 | A | * | 12/1971 | Murase | 70/70 |
| 4,228,666 | A | * | 10/1980 | Perez-Alonso | 70/207 X |
| 4,263,794 | A | * | 4/1981 | Sutliff | 70/207 X |
| 4,574,601 | A | * | 3/1986 | Werk et al. | 70/70 |
| 4,631,937 | A | * | 12/1986 | Debus et al. | 70/207 |
| 4,819,466 | A | * | 4/1989 | Werner | 70/70 |
| 4,848,111 | A | * | 7/1989 | Franzen | 70/69 |
| 4,852,371 | A | * | 8/1989 | Pfeiffer | 70/70 |
| 4,914,931 | A | | 4/1990 | Shu | 70/213 |
| 5,263,750 | A | * | 11/1993 | Smith et al. | 292/DIG. 31 X |
| 5,611,224 | A | * | 3/1997 | Weinerman et al. | 70/208 |
| 5,692,403 | A | * | 12/1997 | Ling | 70/70 X |
| 5,906,291 | A | * | 5/1999 | Mann et al. | 220/756 |
| 5,941,104 | A | * | 8/1999 | Sadler | 70/208 |
| 5,943,886 | A | * | 8/1999 | Chiang | 70/70 |
| 5,984,383 | A | * | 11/1999 | Parikh et al. | 70/208 X |
| 6,029,820 | A | * | 2/2000 | Brown et al. | 206/506 X |
| 6,209,739 | B1 | * | 4/2001 | Samsel | 220/771 X |

OTHER PUBLICATIONS

Air Transport Association of America Specification 300, Jan. 15, 1996.*

* cited by examiner

*Primary Examiner*—Suzanne Dino Barrett
(74) *Attorney, Agent, or Firm*—Brinks Hofer Gilson & Lione

(57) ABSTRACT

A combined handle and lock assembly for use on shipping cases that have limited space available for a separate handle and a separate lock. The combined handle and lock assembly includes a recessed mounting plate that is attached to the front side of the shipping case. A handle is attached with a hinge to the mounting plate and rests within the recessed area when it is not being used. A locking device is included on the bottom portion of the mounting plate.

22 Claims, 2 Drawing Sheets

COMBINED HANDLE AND LOCK ASSEMBLY FOR A SHIPPING CASE

FIELD OF THE INVENTION

The present invention relates generally to shipping cases and, more particularly, to a carrying handle and a locking mechanism.

BACKGROUND OF THE INVENTION

Shipping cases are widely used by individuals to protect a variety of property during transportation from one place to another. In some situations, the individuals are particularly concerned with protecting their property because of either the fragile nature of the property, which allows it to be damaged easily, or because of the high value of the property. In these situations, individuals prefer to pack their property in shipping cases that provide a high degree of durability and security. In all situations, however, individuals desire shipping cases that provide convenient handling.

During transportation, shipping cases are subjected to a wide range of handling methods and are oftentimes outside of the owner's immediate control for long periods of time. One such example involves the use of air transportation for shipping property from place to place. As people familiar with the air transportation business know, a shipping case is usually moved between a number of intermediate storage places by a variety of handling systems before the shipping case finally reaches its destination. The various intermediate storage places can include storage at airport terminals, distribution and sorting stations, transportation trucks, and the cargo holds of airplanes. Likewise, the handling systems usually include a significant amount of manual handling and can also include automatic sorting systems.

Shipping case manufacturers have attempted to satisfy this need for durability, security, and handling convenience with a number of different features. For example, in addressing durability, the U.S. government has published a specification which provides a number of guidelines that should be followed in designing shipping cases to ensure high durability. This specification has been adopted by the general industry and is now referred to as Air Transport Association of America Specification 300, the details of which are hereby incorporated by reference. One guideline included in this industry specification requires that the handles, latches, and locks be recessed below the outer surface of the shipping case to ensure that protruding objects do not become snagged during handling. Another requirement is that the handles remain firmly against the sides of the shipping case so that they are not allowed to flop loosely during handling.

The concern for security has been addressed with a variety of locking devices and latches. Locking devices can include either key locks or combination locks. In some situations, individuals prefer combination locks because this allows them to transport a shipping case to another person and transfer the unlocking code to the other person either orally or in a writing. In other situations, individuals prefer key locks because the key can be retained with the person and an unlocking code does not need to be memorized. Security concerns also require latches that firmly keep the shipping case closed during abusive handling. Typically, turnbuckle latches are provided along each end of the open side of the shipping case to ensure that the shipping case does not accidentally pop open during handling.

Handling convenience is usually addressed by providing several handles in different locations. Commonly, one handle is provided on the long side of the shipping case, and another handle is provided on the small side of the case. Other handling devices are sometimes provided like rolling wheels and extendible tow handles.

One problem that has been encountered in designing smaller shipping cases is the limited amount of space available for the various handles, latches, and locks that are desired by individuals. As discussed above, two latches are generally required along the open side of the shipping case. In smaller shipping cases that are less than about twenty-five inches, a limited amount of space is left remaining between the two latches for a handle or a lock. As a result, shipping case manufacturers generally provide either a handle or a lock between the two latches but are not able to provide both a handle and a lock on the open side of the shipping case.

BRIEF SUMMARY OF THE INVENTION

The present invention provides a combined handle and lock assembly that can be used on shipping cases when limited space exists for a separate handle and a separate lock. The combined handle and lock assembly provides a recessed mounting plate and a spring biased handle in order to satisfy ATA Specification 300. A lock is attached to the mounting plate within the recessed area. One embodiment includes a combination lock. The combination locking device is attached to the lower portion of the locking plate and is positioned so that it can be seen through the circumference of the handle when it is in its recessed position. The strike plate for the combination lock is attached to the back side of the upper portion of the mounting plate.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
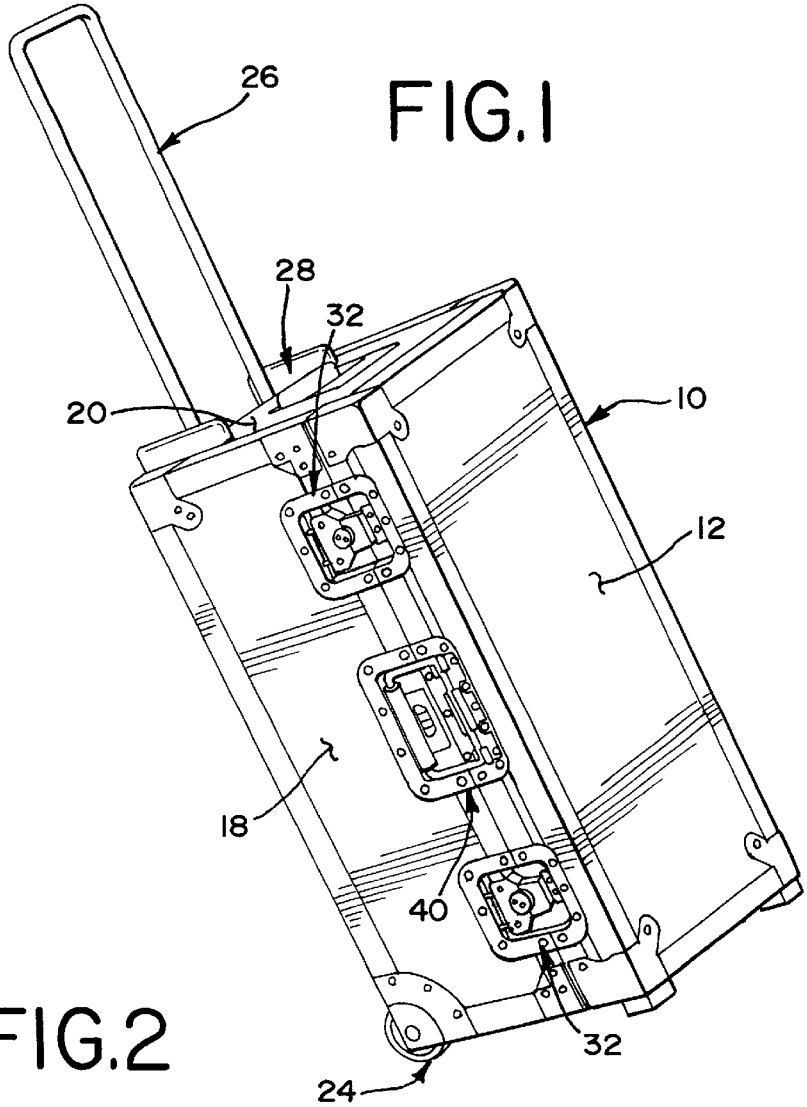
FIG. 1 is a perspective view of a shipping case.
Figure 2:
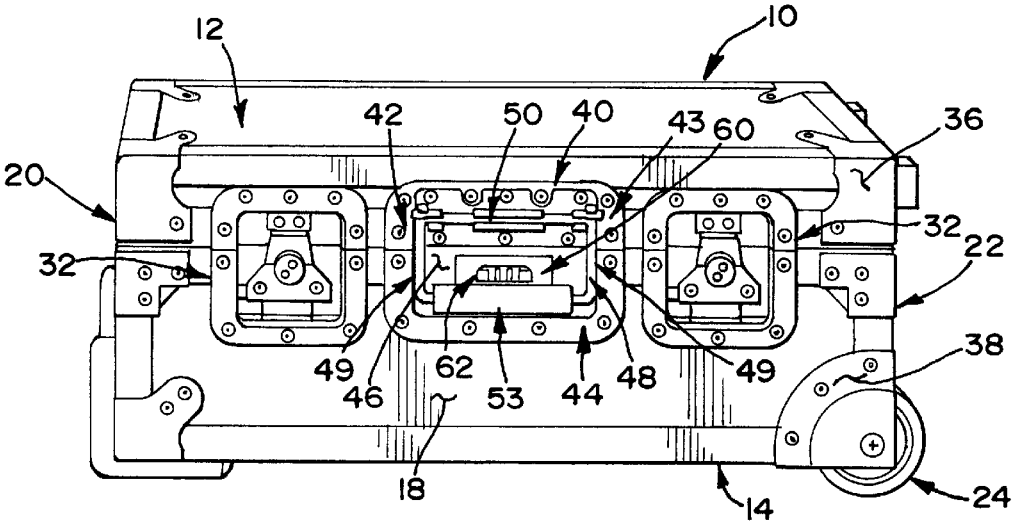
FIG. 2 is a front elevational view of the shipping case.
Figure 3:
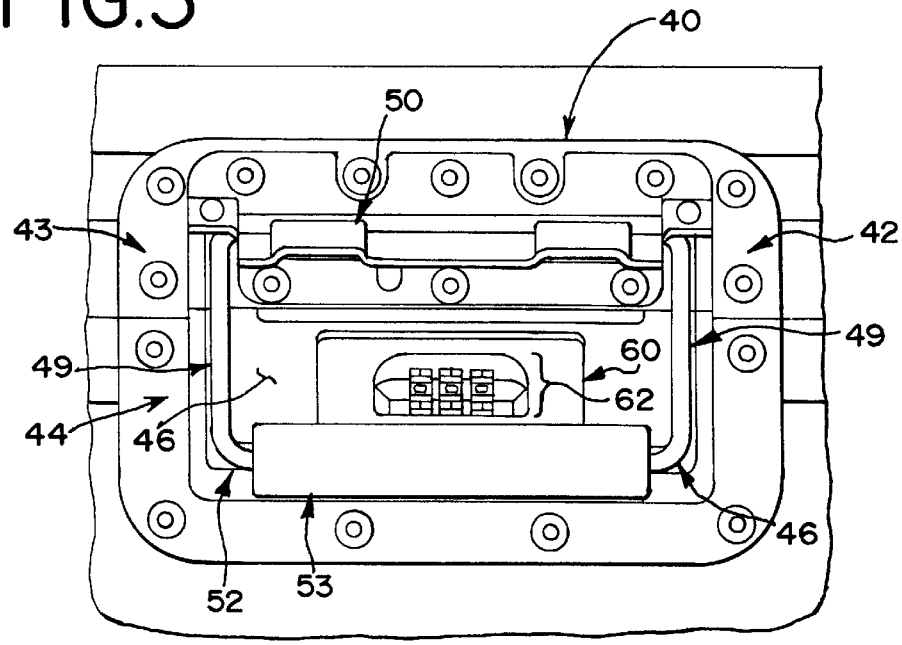
FIG. 3 is a front elevational view of a combined handle and lock assembly.
Figure 4:
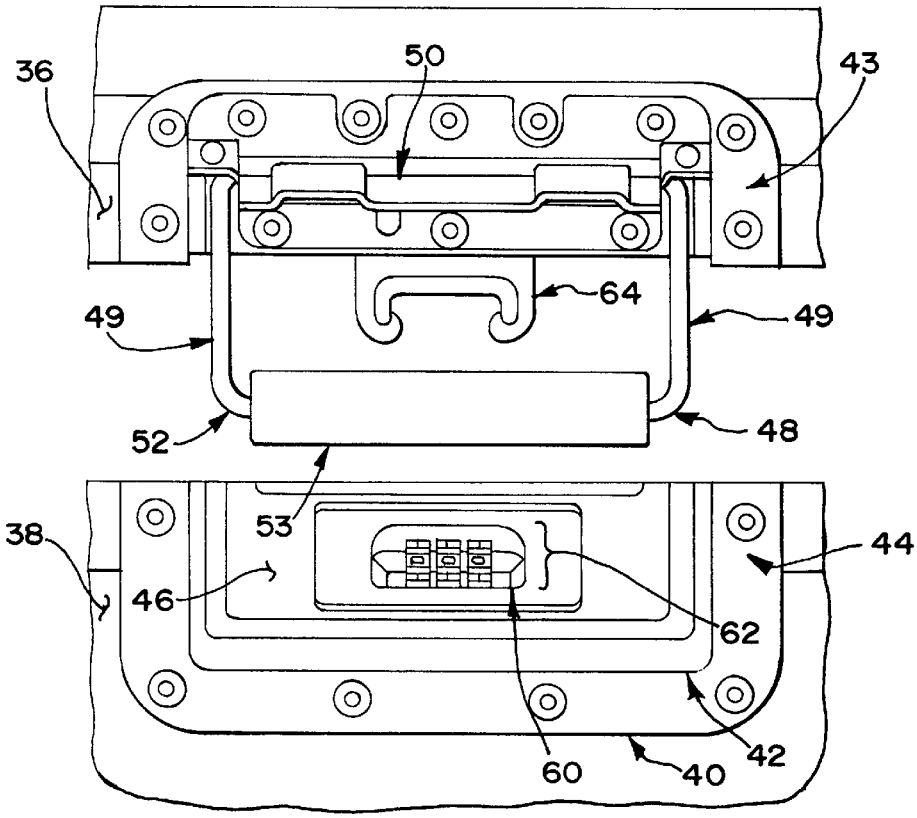
FIG. 4 is a front elevational view of a combined handle and lock assembly; showing the shipping case partly opened.

Referring now to the drawings and the present invention, a shipping case 10 is shown. Although the present invention may be applicable to other shipping cases and even storage devices in general, the preferred embodiment includes a shipping case 10 that is designed to meet category 1 of the Air Transport Association of America (ATA) Specification 300, the details of which are hereby incorporated by reference. ATA shipping cases are designed to be more durable than ordinary shipping cases. For example, category 1 ATA shipping cases must pass a drop test that involves six drops of the shipping case without damaging the contents of the shipping case. With a shipping weight of 40 to 60 pounds, including both the shipping case and the contents, the shipping case is dropped from a height of 18 inches. The drops include one drop onto the top, two drops onto adjacent bottom edges, two drops onto diagonally opposite corners, and one drop onto the bottom. The shipping cases also must pass a puncture test that involves dropping a 6 kilogram bar with a diameter of 3.2 centimeters and a hemispherical end onto the shipping case without penetration of the exterior surface of the shipping case. Finally, the shipping cases must be capable of repair to full serviceability.

The shipping case 10 is box-shaped with a top side 12, a bottom side 14, a back side, a front side 18, a left side 20, and a right side 22. To allow easier movement of the shipping case 10, roller wheels 24 can be provided along the corner between the right side 22 and the bottom side 14. A towing handle 26 on the left side 20 can be used to easily roll the shipping case 10 from place to place. A handle 28 is also provided on the left side 20 to allow the shipping case 10 to be carried with the left side 20, or small end, facing upwards.

The shipping case 10 includes a hinge (not shown) along the back side, which allows the front side 18 of the shipping case 10 to open to allow access to the interior of the shipping case 10. Two latches 32 are provided along the front side 18 to allow the shipping case 10 to be firmly closed, preventing accidental opening of the shipping case 10 during abusive handling. Preferably, the latches 32 are located near the ends of the front side 18 to provide optimal closing retention. Various styles of latches 32 may be used, but the preferred embodiment includes turnbuckle latches 32. The turnbuckle latches 32 are recessed below the outer surface of the shipping case 10 as required by ATA Specification 300 to prevent snagging during handling.

Because of the limited amount of space available on the front side 18 for a handle and a lock, a combined handle and lock assembly 40 is provided between the two latches 32. The assembly 40 includes a two-piece mounting plate 42. The upper portion 43 of the mounting plate 42 is attached to the top portion 36 of the shipping case 10, and the lower portion 44 of the mounting plate 42 is attached to the bottom portion 38 of the shipping case 10. The upper portion 43 and lower portion 44 of the mounting plate 42 can also be a first portion 43 and a second portion 44 that are attached to the shipping case 10 in various orientations. Various attaching systems for the mounting plate 42 are possible, including rivets as shown along the outer edge of the mounting plate 42. Like the latch 32 and the handle 28 on the left side 20, the mounting plate 42 is recessed 46 to satisfy ATA Specification 300. The recessed area 46 is about 8 mm in depth. Like the left side handle 28 also, the handle 48 includes a spring (not shown) along the top, hinged side 50 to force the handle 48 into the recessed area 46 when it is not being used. To ensure a convenient size for the handle 48, the recessed area 46 is about 75 mm high and about 130 mm wide. Accordingly, the handle 48 substantially fills the circumference of the recessed area 46 when the handle 48 is against the side of the shipping case 10. A gripping portion 53 is also provided on the bottom, unhinged side 52 of the handle 48.

The combined handle and lock assembly 40 also includes a lock 60 attached to the mounting plate 42. Several different locking devices 60 are possible, including a combination lock 60 as shown in the figures. The lock 60 is horizontally positioned between the opposing ends 49 of the handle 48. Preferably, the unlocking interface 62, or the area of the lock that the user interacts with, is located within the circumference of the handle 48 so that the locking interface can be seen or actuated when the handle 48 is within the recessed area 46. Although the lock 60 may be attached to the mounting plate 42 in a number of different locations, the embodiment shown has a combination lock 60 attached to the lower portion 44 of the mounting plate 42 within the recessed area 46. The strike plate 64 which locks into the combination locking device 60, is attached to the back side of the upper portion 43 of the mounting plate 42.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

We claim:

1. A shipping case configured according to Air Transport Association of America Specification 300, comprising:

a) a carrying handle with a hinge, a grip, and opposing ends;

b) a lock that is positioned between said hinge and said grip when said handle is at rest against said shipping case and is further positioned between said opposing ends of said handle;

c) a recessed area within which said handle can rest in order to prevent snagging of the handle during handling; and d) a bias member that forces said handle within said recessed area when said handle is not being used.

2. The shipping case according to claim 1, wherein said shipping case is capable of passing a drop test that involves six drops of the shipping case without damaging the contents of the shipping case, with a shipping weight of 40 to 60 pounds, including both the shipping case and the contents, the shipping case being dropped from a height of 18 inches, the drops including one drop onto the top, two drops onto adjacent bottom edges, two drops onto diagonally opposite corners, and one drop onto the bottom.

3. The shipping case according to claim 2, wherein said shipping case is capable of passing a puncture test that involves dropping a 6 kilogram bar with a diameter of 3.2 centimeters and a hemispherical end onto the shipping case without penetration of the exterior surface of the shipping case.

4. The shipping case according to claim 1, wherein said recessed area is about 8 mm deep and 75 mm high and 130 mm wide.

5. The shipping case according to claim 4, wherein said lock can be seen through said handle when said handle is within said recessed area.

6. The shipping case according to claim 4, wherein said lock can be actuated through said handle when said handle is within said recessed area.

7. The shipping case according to claim 1, wherein said bias member is a spring.

8. The shipping case according to claim 1, wherein said lock is a combination lock.

9. The shipping case according to claim 1, further comprising:

a) mounting plate with said recessed area formed into said mounting plate;

b) said handle attached to said mounting plate and resting substantially within said recessed area when said handle is not being used; and c) said lock attached to said mounting plate within said recessed area.

10. The shipping case according to claim 9, wherein:

a) said mounting plate includes a first portion that is attached to a first portion of said shipping case and a second portion that is attached to a second portion of said shipping case;

b) said handle is attached with said hinge to said first portion of said mounting plate; and c) said lock is attached to said second portion of said mounting plate.

11. The shipping case according to claim 10, wherein said lock can be seen through said handle when said handle is within said recessed area.

12. The storage device according to claim 11, wherein said shipping case is capable of passing a drop test that involves six drops of the shipping case without damaging the contents of the shipping case, with a shipping weight of 40 to 60 pounds, including both the shipping case and the contents, the shipping case being dropped from a height of 18 inches, the drops including one drop onto the top, two drops onto adjacent bottom edges, two drops onto diagonally opposite corners, and one drop onto the bottom.

13. The shipping case according to claim 12, wherein said shipping case is capable of passing a puncture test that involves dropping a 6 kilogram bar with a diameter of 3.2 centimeters and a hemispherical end onto the shipping case without penetration of the exterior surface of the shipping case.

14. The shipping case according to claim 13, wherein said recessed area is about 8 mm deep and 75 mm high and 130 mm wide.

15. A shipping case configured according to Air Transport Association of America Specification 300 with a combined handle and lock assembly, comprising:

a) a mounting plate with a recessed area;

b) a carrying handle attached to said mounting plate with a hinge so that said handle can rest within said recessed area in order to prevent snagging of the handle during handling, wherein said hinge includes a spring that forces said handle within said recessed area when said handle is not being used; and c) a lock attached to said mounting plate and positioned within said recessed area.

16. The shipping case according to claim 15, wherein said recessed area is about 8 mm deep and 75 mm high and 130 mm wide.

17. The shipping case according to claim 15, wherein:

a) said mounting plate includes a first portion for attachment to a first portion of a shipping case;

b) said handle is attached with said hinge to said first portion of said mounting plate;

c) said mounting plate includes a second portion for attachment to a second portion of said shipping case; and d) said lock is attached to said second portion of said mounting plate.

18. The shipping case according to claim 17, wherein said recessed area is about 8 mm and 75 mm high and 130 mm wide.

19. The shipping case according to claim 18, wherein said lock is a combination lock.

20. A shipping case configured according to Air Transport Association of America Specification 300, comprising;

a) a carrying handle with a hinge, a grip, and opposing ends;

b) a combination lock that is positioned between said hinge and said grip when said handle is at rest against said shipping case and is further positioned between said opposing ends of said handle;

c) a recessed area within which said handle can rest in order to prevent snagging of the handle during handling;

d) a spring that forces said handle within said recessed area when said handle is not being used;

e) a mounting plate with said recessed area formed into said mounting plate;

f) said handle being attached to said mounting plate and resting substantially within said recessed area when said handle is not being used;

g) said combination lock being attached to said mounting plate within said recessed area; and h) said mounting plate including a first portion that is attached to a first portion of said shipping case and a second portion that is attached to a second portion of said shipping case, said first and second portions of said shipping case being separable to allow access to an interior of said shipping case.

21. The shipping case according to claim 20, wherein said shipping case is capable of passing a drop test that involves six drops of the shipping case without damaging the contents of the shipping case, with a shipping weight of 40 to 60 pounds, including both the shipping case and the contents, the shipping case being dropped from a height of 18 inches, the drops including one drop onto the top, two drops onto adjacent bottom edges, two drops onto diagonally opposite corners, and one drop onto the bottom.

22. The shipping case according to claim 21, wherein said shipping case is capable of passing a puncture test that involves dropping a 6 kilogram bar with a diameter of 3.2 centimeters and a hemispherical end onto the shipping case without penetration of the exterior surface of the shipping case.

* * * * *

UNITED STATES PATENT AND TRADEMARK OFFICE

CERTIFICATE OF CORRECTION

PATENT NO. : 6,449,993 B2 
DATED : September 17, 2002
INVENTOR(S) : Edwin B. Elliott et al.

It is certified that error appears in the above-identified patent and that said Letters Patent is hereby corrected as shown below:

Column 5,
Line 4, delete "storage device" and substitute -- shipping case -- in its place.

Signed and Sealed this

Twenty-ninth Day of July, 2003

JAMES E. ROGAN
*Director of the United States Patent and Trademark Office*